US005286956A

United States Patent [19]

Mochizuki

[11] Patent Number: 5,286,956

[45] Date of Patent: Feb. 15, 1994

[54] PRINTER HAVING PAGE-TURNING APPARATUS FOR PASSBOOKS AND WITH PAGE-TURNING CAPABILITY EVEN AFTER INITIAL DEFORMATION OF SHEETS TO BE TURNED

[75] Inventor: Akira Mochizuki, Ibaraki, Japan

[73] Assignee: Hitachi, Ltd., Tokyo, Japan

[21] Appl. No.: 707,797

[22] Filed: May 30, 1991

[30] Foreign Application Priority Data

May 30, 1990 [JP] Japan ..... 2-138220

[51] Int. Cl.[5] ..... B42D 9/04

[52] U.S. Cl. ..... 235/432; 40/531; 400/24; 902/19

[58] Field of Search ..... 400/24; 40/531; 902/19; 235/379, 432

[56] References Cited

U.S. PATENT DOCUMENTS

| | | | |
|---|---|---|---|
| 4,280,036 | 7/1981 | Fukats | 235/379 |
| 4,488,367 | 12/1984 | Yamauchi et al. | 40/531 |
| 4,545,141 | 10/1985 | Ito et al. | 40/531 |
| 4,700,497 | 10/1987 | Sato et al. | 40/531 |
| 4,870,258 | 9/1989 | Mochizuki et al. | 235/379 |

FOREIGN PATENT DOCUMENTS

| | | | |
|---|---|---|---|
| 281998 | 11/1989 | Japan . | |
| 6185 | 1/1990 | Japan . | |
| 81693 | 3/1990 | Japan . | |
| 2104493 | 3/1983 | United Kingdom . | |
| 2211826 | 7/1989 | United Kingdom | 40/531 |
| 2222819 | 3/1990 | United Kingdom . | |

*Primary Examiner*—John Shepperd

*Attorney, Agent, or Firm*—Antonelli, Terry Stout & Kraus

[57] ABSTRACT

In a printer for passbooks or the like, a passbook or the like, which is brought in on a transfer path, is stopped at the position of a page-turning roller, where a sheet is turned over by the operation of the page-turning roller. When a sheet is turned over by the page-turning roller, at a position separate from a start position of turning over of a sheet, a passbook or the like undergoes an initial deformation in a out-of-plane direction so that the passbook is bent in a first-order mode. By this initial deformation, a sheet can be turned over steadily. Such a turnover of the sheet can be effected in conjunction with utilizing an optical system which provides an image of the three-dimensional deformation pattern of the passbook which is processed. In accordance with this pattern a decision is made whether or not the out-of-plane deformation of the passbook is more than a specified amount. In the vicinity of the transfer path, a page-turning roller is provided and is supported rotatably. In the vicinity of the transfer path there is also provided a push guide which gives a deformation to the passbook when a sheet is turned over. Based on a frictional control of the page-turning operation, a steady turnover of the sheet can be effected regardless of buckling resistance force of the sheet to be turned over.

9 Claims, 12 Drawing Sheets

PRINTER HAVING PAGE-TURNING APPARATUS FOR PASSBOOKS AND WITH PAGE-TURNING CAPABILITY EVEN AFTER INITIAL DEFORMATION OF SHEETS TO BE TURNED

BACKGROUND OF THE INVENTION

1. Industrial Field

This invention relates to a printer and a page turning apparatus for passbooks or the like suitable for passbook printers built in terminal apparatuses or passbook issuing machines handled by tellers of banks or other financial agencies.

2. Description of the Prior Art

In the banks and other financial agencies, there are installed cash dispenser, cash depositors, Automated Teller Machines (ATM) and other banking terminals that the customer uses. These machines have a passbook printer built in for entering the amounts of transactions in the passbooks.

Likewise, in banks and other financial agencies, there are passbook issuing machines used by tellers.

Generally, passbooks have double-spread pages, and if there is no column to enter the sum of transaction on a given page of the passbook, it is necessary to turn over the page to the next page. For turning over pages, there are two methods: the user previously opens a desired page and inserts the passbook into the machine; or an automatic page-turning device in the passbook printer or in the passbook issuing machine performs a page-turning operation.

As an example of prior art automatic page-turning machines of this kind for printers of passbooks or the like, there is a well-known apparatus disclosed in U.S. Pat. No. 4,280,036. This apparatus has a passbook pressing member which, when turning over a page causes the pressing member to be pressed against the passbook, thereby bringing the page-turning roller into contact with the cover or an intermediate page. A frictional force is produced between the page-turning roller and the cover or the intermediate page of the passbook, and the page-turning roller is rotated clockwise to displace the uppermost sheet in the direction of the binding line of the passbook to be curved upwards to be turned over. For this page-turning operation, a sheet to be turned over is assumed to be flat, and the pressing member is controlled so that the frictional force to be produced is greater than the resistance of the uppermost sheet but is of a magnitude not to cause the other sheets under the uppermost sheet to be turned over. Each time a page is turned over, the passbook is moved into and out of the set position for paging.

The problem with the prior art apparatus is that the pressing member has to be installed to press the page-turning roller against the page of the passbook on which data is entered. Specifically, the pressing member needs to apply an optimal force between the page-turning roller and the sheet surface to such an extent as not to cause a paging error. Adjustment for setting this optimal pressing force is difficult (in other words, variation is likely to occur because of manufacturing tolerance). To meet the above requirement, the composition of the apparatus has to be complex. In addition the positioning of the pressing member in a limited space of the terminal apparatus requires greater time and labor in the manufacturing process. Thus, the production cost is higher, and an increased number of parts causes a greater difficulty in assuring the reliability of the apparatus.

In a passbook or the like, which has a complicated initial shape, a sheet of this passbook will exhibit resistance of several times to more ten times greater than the resistance of a sheet of a passbook which is flat. In this case, the sheets sometimes cannot be turned over.

SUMMARY OF THE INVENTION

An object of this invention is to provide a printer for passbooks or the like and a page-turning apparatus, wherein a page-turning roller itself produces a page-turning force, and wherein the pressing mechanism has been done away with, thus simplifying the apparatus construction and enabling the sheets to be turned over one after another steadily. In accordance with this, an improved page-turning apparatus is comprised of: page-turning means which contacts and turns over a specified sheet of the passbook or the like which is brought in the transfer path; means for processing an image of the passbook or the like so as to determine an amount of three-dimensional deformation of the passbook or the like prior to an initial deformation; and means, which is disposed in the vicinity of the page-turning means and which is in a position separate from the start position of effecting a turning over of a sheet by the page-turning means, for giving an initial deformation to the passbook or the like, in which the amount of the initial deformation varies in response to the amount of the deformation determined in accordance with the three-dimensional pattern. Also, according to the invention, there is further included means for making a decision of whether the page-turning operation is normal or abnormal in synchronism with the page-turning operation by the page-turning means; means for counting a number of page-turning operations in a series; and means for controlling the page-turning operation in accordance with the count of the counting means.

Another object of this invention is to provide a printer for passbooks or the like and a page-turning apparatus, which are highly reliable and which stably perform turning-over of sheets of a passbook or the like which has an initial irregularity in shape. The printer for passbooks or the like according to this invention comprises page-turning means for turning over a specified page of a passbook or the like and means for giving an initial deformation to a passbook or the like to facilitate turning over of a sheet.

According to this invention, the friction-applying part of the page-turning means generates an optimal frictional force which is necessary for turning over of a sheet for various thicknesses of the passbook or the like, and reduces the effect of the initial irregularity in shape of the passbook or the like and enables a highly reliable page-turning operation. In accordance with this objective, the printer for passbooks or the like is comprised of: a transfer path having transfer means for transferring the passbook or the like; printing means for printing on a specified page of the passbook or the like which is brought in on the transfer path; means for processing an image of the passbook or the like so as to determine an amount of three-dimensional deformation of the passbook or the like prior to an initial deformation; means for reading and writing magnetic information on the passbook or the like; page-turning means disposed in the vicinity of the transfer path for contacting and turning over a sheet of the passbook or the like; and means, which is disposed in the vicinity of the transfer path and which is in a position separate from a start position of turning over a sheet by the page-turning means, for giving initial deformation to the passbook or the like. In accordance with this, the amount of initial deformation varies in response to the determined amount of deformation of the three-dimensional pattern. Additional advantages and improved aspects directed to the invention disclosed will become apparent and fully understood from a reading of the following description in conjunction with the accompanying illustrations, briefly described hereinbelow.

DESCRIPTION OF THE PREFERRED EMBODIMENTS

Preferred embodiments of this invention will be described with reference to the accompanying drawings.

Figure 1:
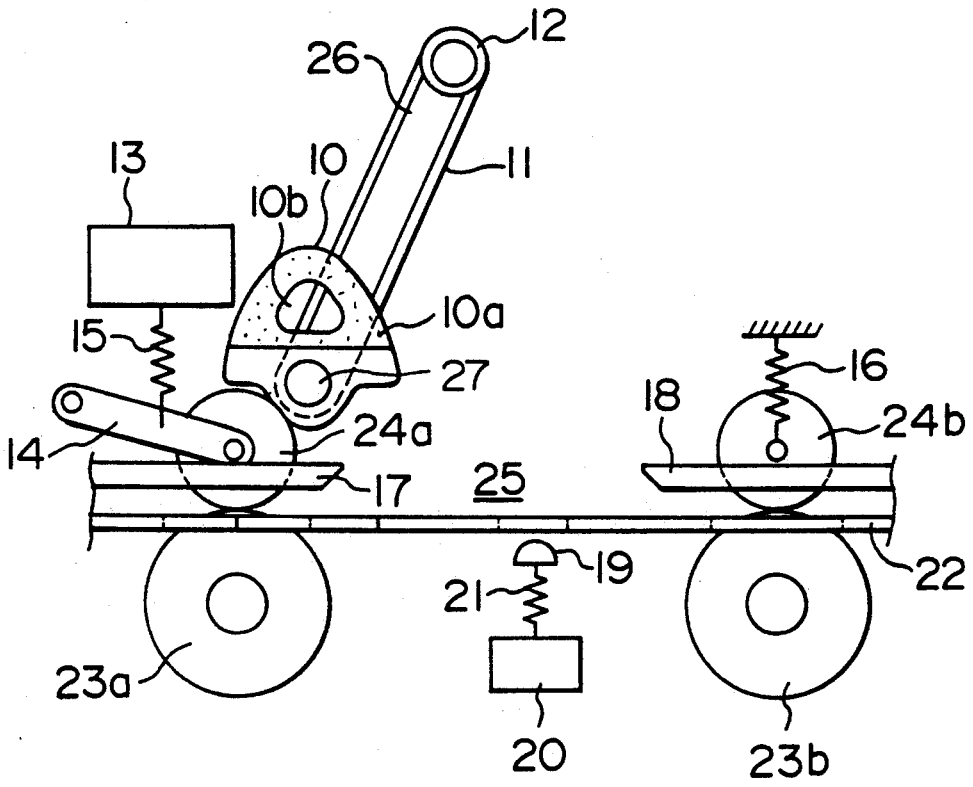
FIG. 1 is a side view of the page-turning mechanism of a passbook printer or the like in accordance with the present invention.

FIG. 1 is a side view of the page-turning mechanism in a passbook printer or the like printer in accordance with the invention.

A transfer path 25 for transferring a passbook into and out of the page-turning mechanism is formed by transfer rollers 23*a*, 23*b*, transfer rollers 24*a*, 24*b* kept in contact with the transfer rollers 23*a*, 23*b* by springs 15, 16, a paper pan 22 as a first guide, and paper pans 17, 18 as a second guide. In the vicinity of the transfer path 25, there is provided a page-turning roller 10 having a hollow-structured friction contact part 10*a*. This page-turning roller 10 is supported rotatably on an extreme end side of an arm 26 pivotably mounted to a shaft 12, and is turned about a shaft 27 at the extreme end of the arm 26 in the clockwise or counterclockwise direction by a drive-transmission belt 11 driven by a drive source, not shown. The above-mentioned friction contact part 10*a* is made of a material with a friction coefficient of about one or more such as natural rubber or butadiene rubber. The above-mentioned transfer roller 24*a* is supported rotatably to the extreme end of a link 14 mounted pivotably, and can be detached from the transfer roller 23*a* by the operation of a drive source 13 through a spring 15 and the link 14. In the vicinity of the transfer path 25, there is provided a push guide 19 at a position separate from a start position of a page-turning operation by the page-turning roller 10 and on the side across the transfer path 25 from the page-turning roller 10. This push guide 19 gives a deformation to a passbook when a sheet is turned over. The amount of movement of the push guide 19 is given by a spring 21 and a drive source 20.

Figure 2:
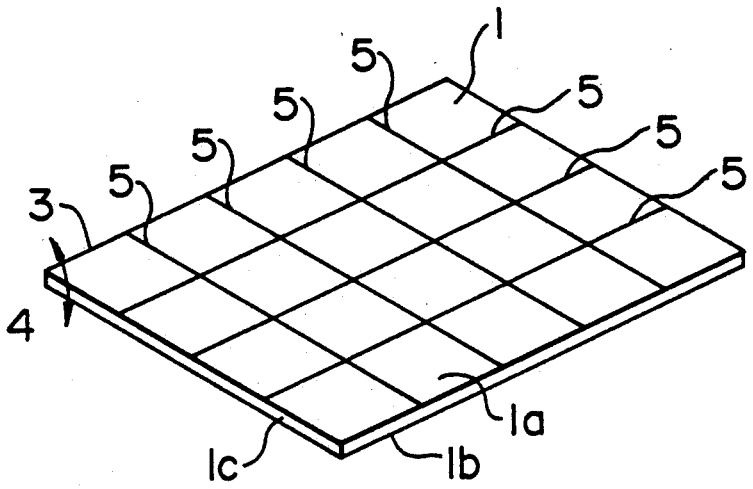
FIGS. 2 and 3 are views showing a passbook or the like such as a passbook to be handled.
Figure 3:
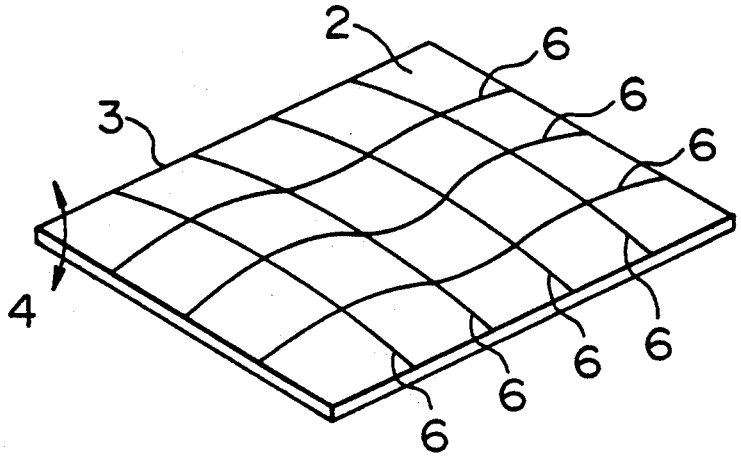

FIG. 2 shows a passbook 1 without an initial irregularity in shape, while FIG. 3 shows a passbook 2 with an initial irregularity in shape. In FIGS. 2, 3, the passbook is closed. The passbook 1 comprises a top sheet 1*a*, a rear sheet 1*b*, and middle sheets 1*c*. Those sheets have been bounded by a binding line 3. The page-turning direction is indicated by an arrow 4. To represent the flatness of the passbook 1, auxiliary lines 5 are shown on the passbook 1. As is well-known in strength of materials, the buckling load of a flat, plate-like element such as the passbook 1 can be approximated by the Euler equation.

As shown in FIG. 3, however, in the passbook 3 with an initial irregularity, the buckling load is several times to several decades greater than the value obtained by the Euler equation mentioned above. The diagram of FIG. 3 was obtained by moire analysis of an actual passbook.

Figure 4:
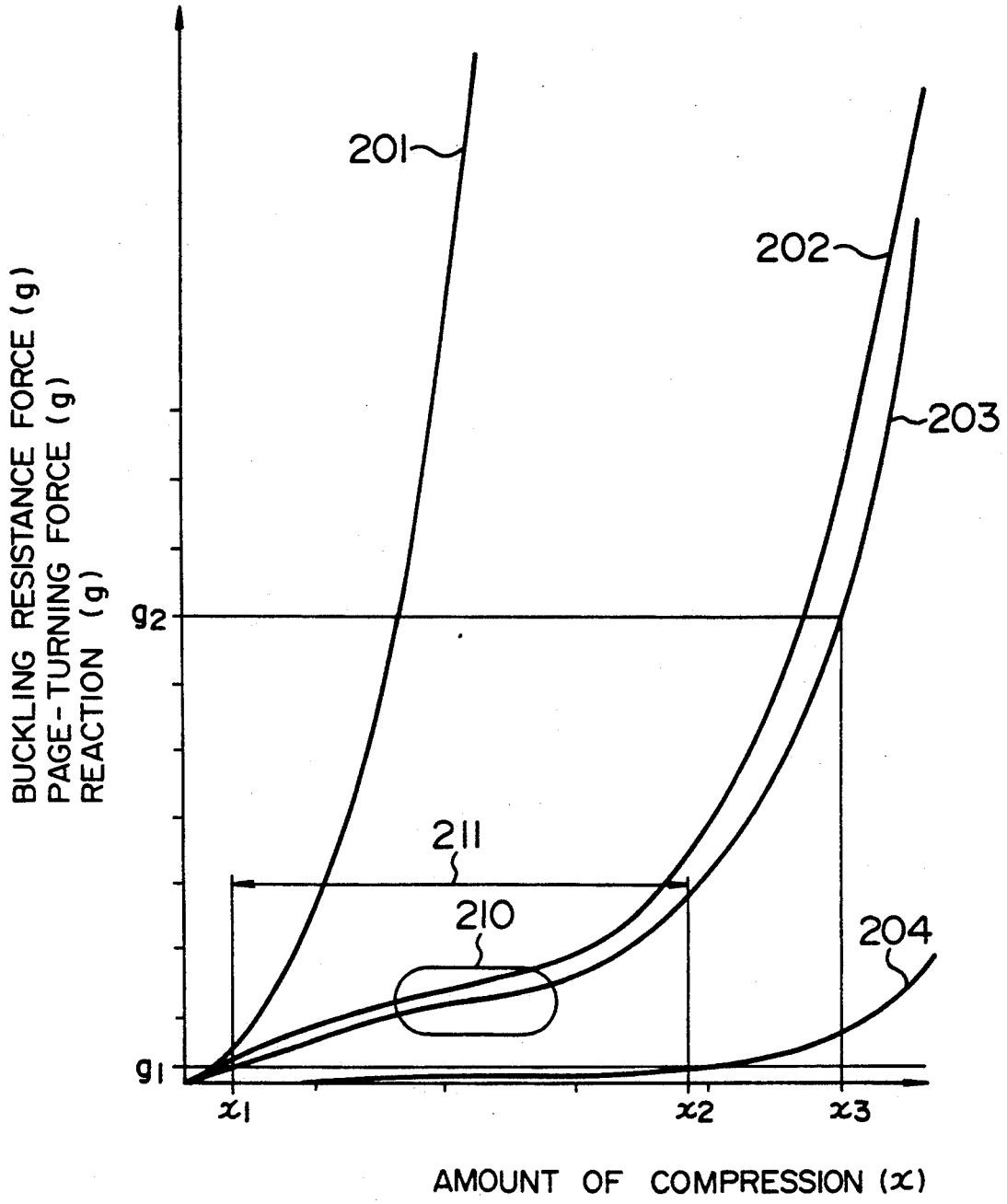
FIG. 4 is a diagram showing the relation between the compression amount and the resistance of the page-turning roller.

In FIG. 4, the abscissa represents the amount of compression caused by the friction contact part 10*a* of the page-turning roller 10, while the ordinate represents the reaction, the buckling resistance force and the turning force that occur when the friction contact part 10*a* of the page-turning roller 10 is compressed.

A curve 201 of FIG. 4 shows the relation between the reaction and the amount of compression of the prior-art page-turning roller whose friction contact part 10*a* has no hollow portion. For the above-mentioned page-turning roller 10 with the friction contact part 10*a* structured to have a hollow portion 10*b*, the reaction - compression amount curve 202 has a non-linear inflection point as shown in FIG. 4. In this curve 202, there is a region 210 which is very insensitive to the compression amount X. This compression amount X is the amount that the page-turning roller 10 is compressed and deformed. While in contact with a sheet of a passbook, the page-turning roller 10 turns it over by a frictional force. The page-turning force can be approximated by a product of a vertical resistance of the deformation reaction of the friction contact part 10*a* and a friction coefficient of the friction contact part 10*a*. This page-turning force is represented by a curve 203. The force required for turning over the next sheet adjacent to the sheet which is being turned over is equal to a difference between two frictional forces: one force between the sheet being turned over and the next sheet beneath it and the other force between the next sheet and the second next sheet in contact therewith. This page-turning force is shown by a curve 204.

Next, with reference to FIG. 4, a description will be made of the range of the amount of compression in which only one sheet of a passbook 1 that is to be turned over can be turned over steadily. In the range between where the curve 204 does not exceed a buckling resistance force $g_1$ of the sheet concerned and in the range where the curve 203 exceeds the buckling resistance force $g_1$, a single sheet can be turned over reliably. It is easily understood that this region 211 is far wider than a region obtained by conversion from the curve 201.

The above-mentioned buckling resistance force $g_1$ can be approximated by the Euler load when a sheet to be turned over is deformed in the first-order mode. The buckling resistance forces of passbooks shown in FIGS. 2, 3 correspond to $g_1$, $g_2$.

The range 211 of the adequate amount of compression for steadily turning over a single sheet is not adequate if the buckling resistance force is $g_2$. Therefore, by using the push guide 19 shown in FIG. 1 it is necessary to give an initial deformation to a passbook in the first-order mode, and decrease the buckling resistance force from $g_2$ to close to $g_1$.

Figure 5:
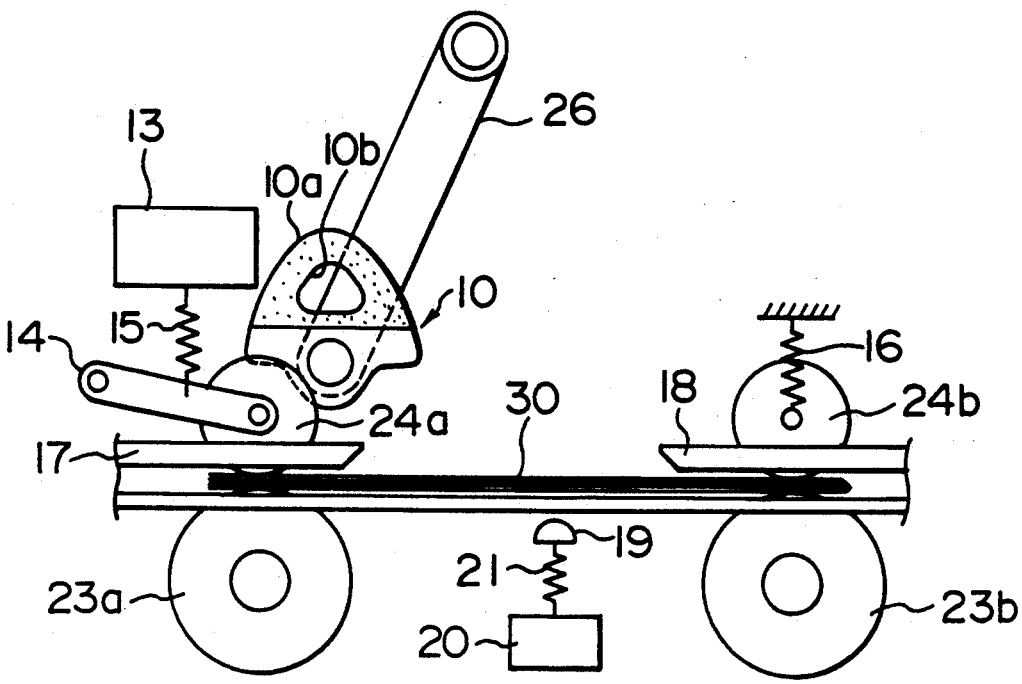
FIGS. 5 to 15 are diagrams for explaining motion of the page-turning mechanism of FIG. 1.
Figure 6:
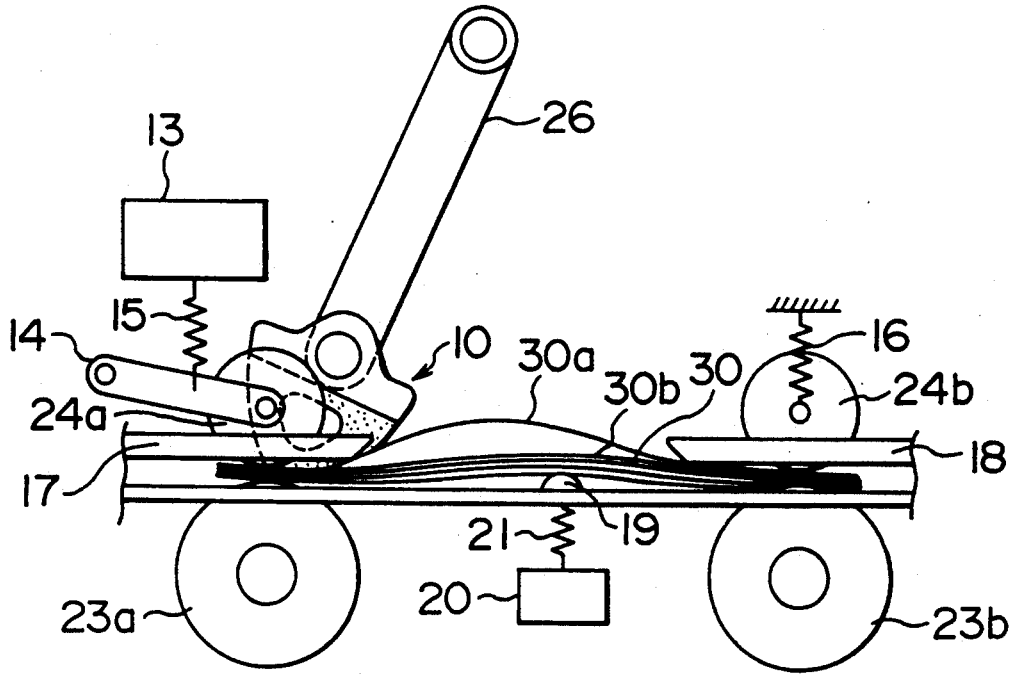

Referring to FIGS. 5 to 9, the operation of turning over the top sheet of a passbook 30 will now be described. A passbook 30 is brought to a specified position (FIG. 5). As has been described with reference to FIG. 3, the buckling resistance force of the passbook 2 with an initial irregularity corresponds to $g_2$, which is substantially larger than $g_1$ as shown in FIG. 4. For this reason, a single sheet cannot be turned over reliably which has been described with reference to FIG. 4. By using the push guide of FIG. 6, the passbook is subjected to an initial deformation in a first-order mode as shown in FIG. 6, thereby lessening the effect of the initial irregularity presented in FIG. 3. The reason why the buckling resistance force of the passbook 2 with the initial irregularity of FIG. 3 is higher than the flat passbook of FIG. 2 is because the buckling mode is represented in a higher-degree mode and also because a local snap through occurs. Meanwhile, the page-turning roller 10, while rotating, comes into contact with the passbook which has been subjected to the initial deformation by the push guide 19. In this process, as shown in FIG. 6, the transfer roller 24*a* is raised for a specified time period by an operation of the drive source 13 through the intermediary of the spring 15 and the link 14. By this motion, the transfer roller 24*a* is prevented from offering resistance to the sheet being turned over. The above-mentioned time period should most desirably be almost the same as a time period in which the page-turning roller 10 is applying a specified force to the passbook. However, the above-mentioned time period may be longer than this and may be up to a point in time that the page-turning roller 10 has rotated to a specified position.

If the above-mentioned time is set to be substantially the same as the time in which the specified force is applied, a favorable effect is that the next sheet 30*b*–under the sheet which is to be turned over – is prevented from being turned over at the same time.

Figure 7:
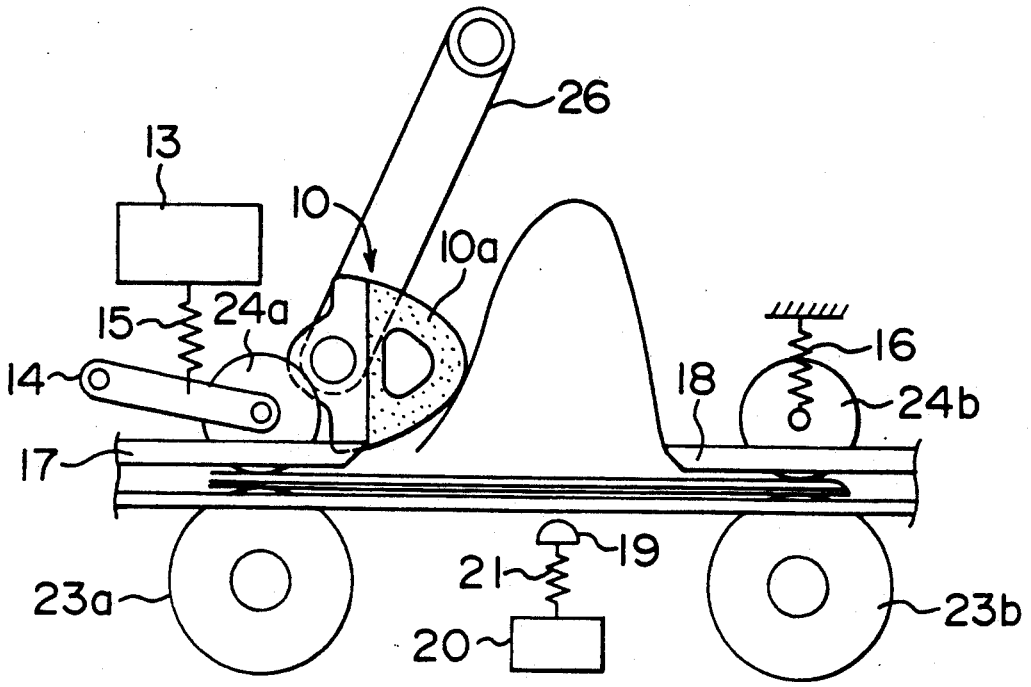
Figure 8:
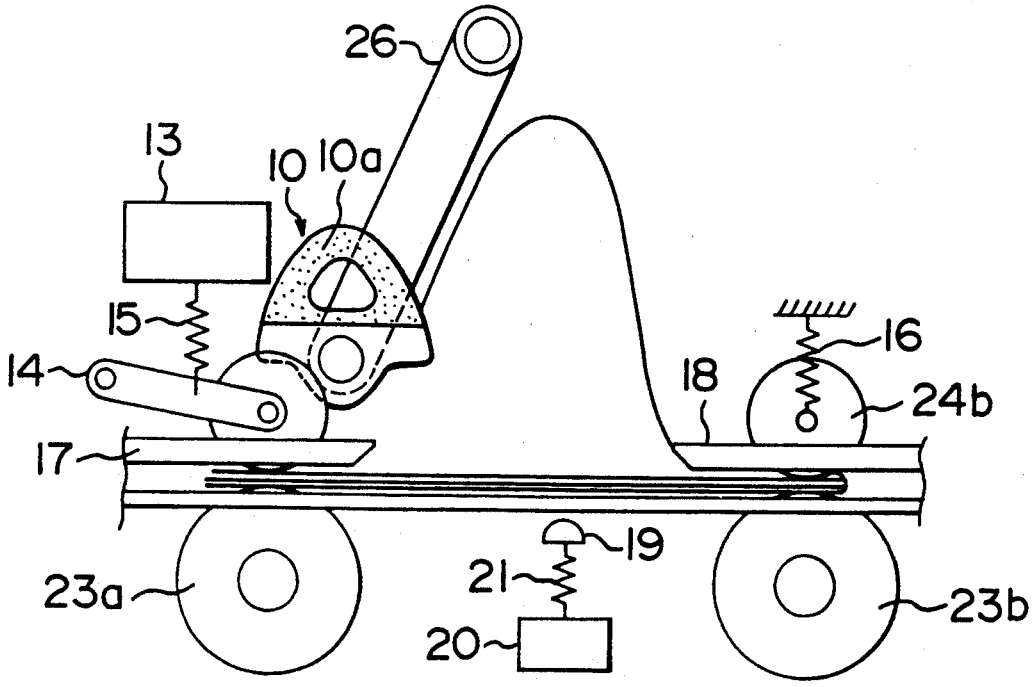
Figure 9:
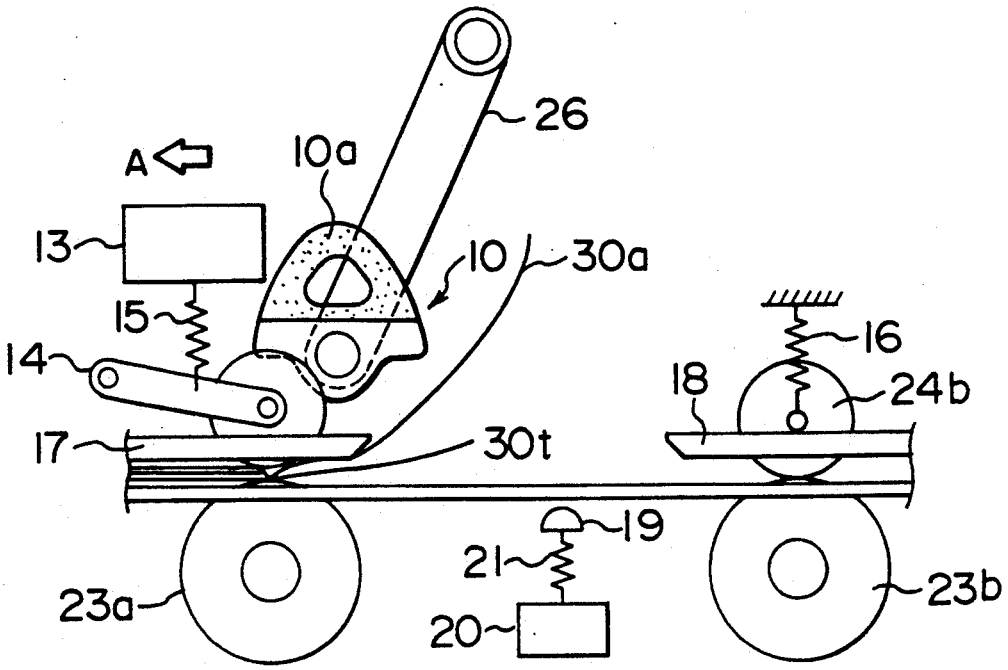

When the page-turning roller 10 has rotated for a specified angle of rotation, the push guide 19 and the transfer roller 24*a* finish their respective motions, and return to the initial position (FIG. 7). On completion of the rotation, the page-turning roller 10 stops at a specified position (FIG. 8). Then, the passbook is conveyed in the direction of an arrow A of FIG. 9 by the transfer rollers 23*a* and 24*a*. By this motion, the sheet 30*a* thus curved is turned over about the binding line, thus completing the page-turning operation (FIG. 9).

Figure 10:
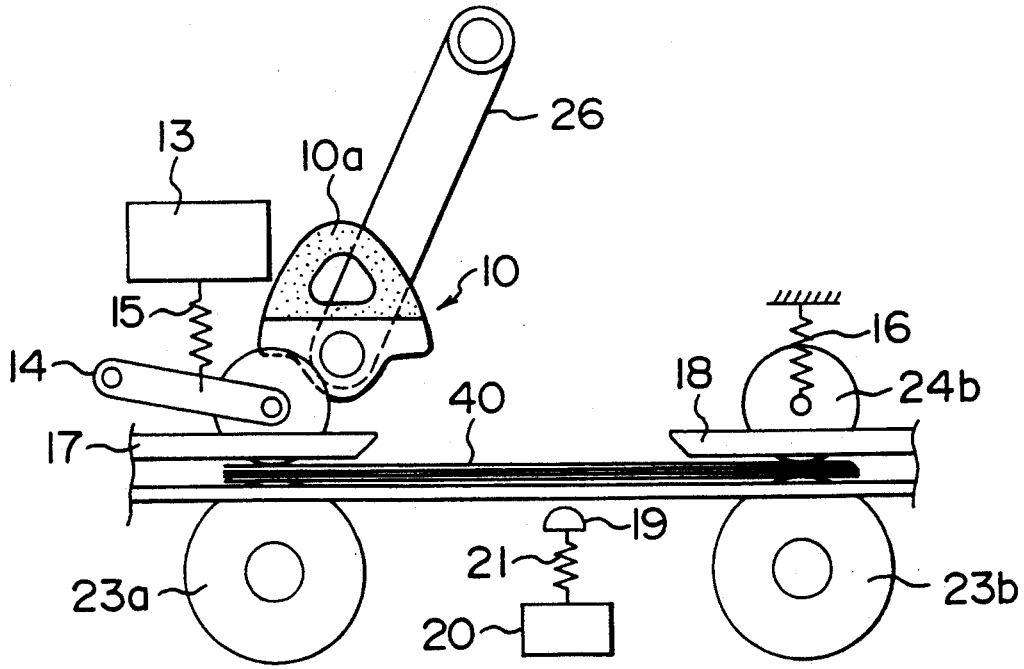

Referring to FIG. 10, description will be made of turning over of a top sheet 1*a* of a flat passbook or a passbook with a slight initial irregularity but with hardly any increase in the buckling resistance force (described with reference to FIG. 2) or a thin sheet (middle sheet 1*c*, for example) not showing a resistance force in excess of the inflection point region 210 of the curve 202 of FIG. 4 (the buckling resistance force $g_2$, for example) even if the buckling resistance force is increased by the effect of the initial irregularity because the original buckling force is small. To differentiate from the turning operation of the top sheet mentioned above, reference is made to the latter operation as the middle sheet turning operation.

To judge that a passbook has a very small initial irregularity or the passbook is flat, a camera, moire fringes or an optical system may be arranged in the passbook printer. In this case, an image of a three-dimensional deformation pattern of a passbook is processed, and a decision is made whether or not the out-of-plane deformation of the passbook is more than a specified amount are as follows. The amount of initial deformation is variable according to the result of processing of the three-dimensional pattern.

Figure 11:
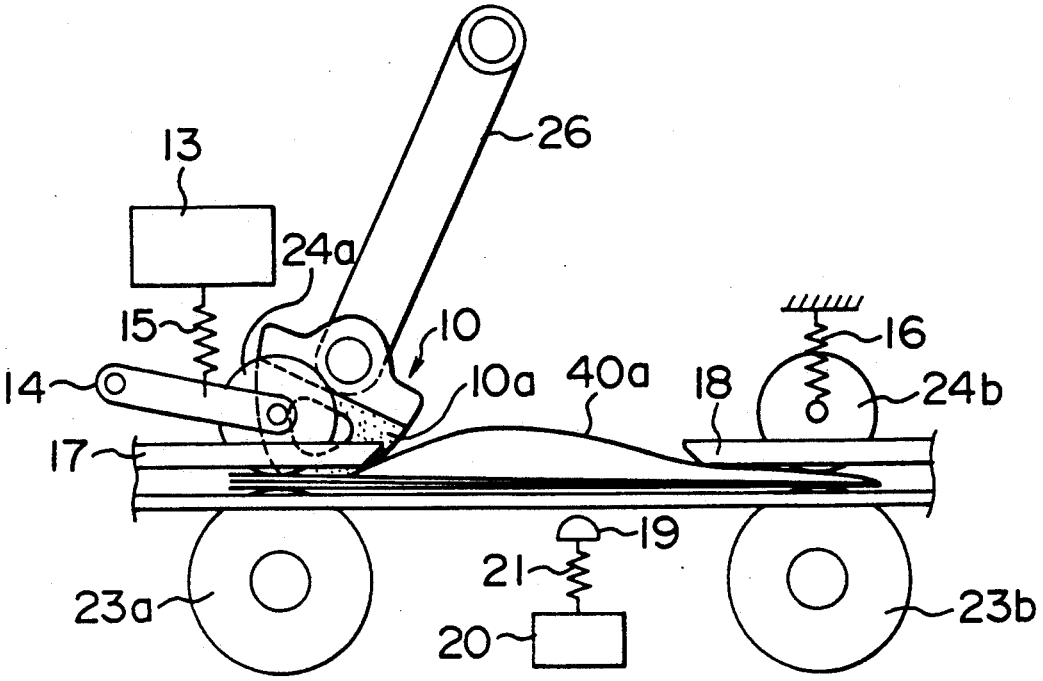
Figure 12:
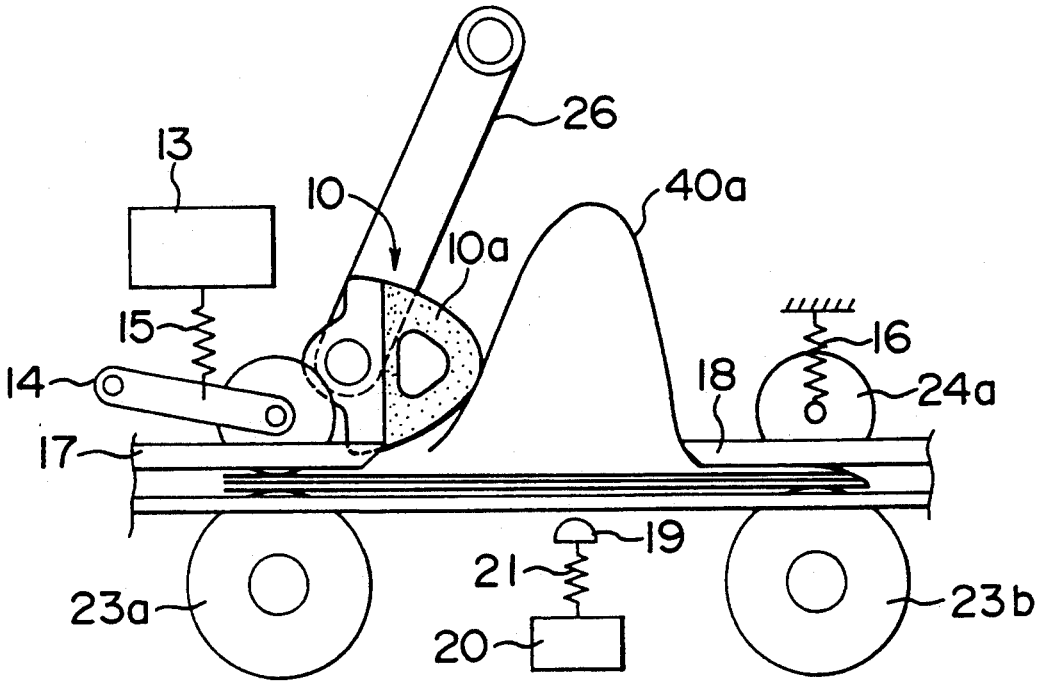
Figure 13:
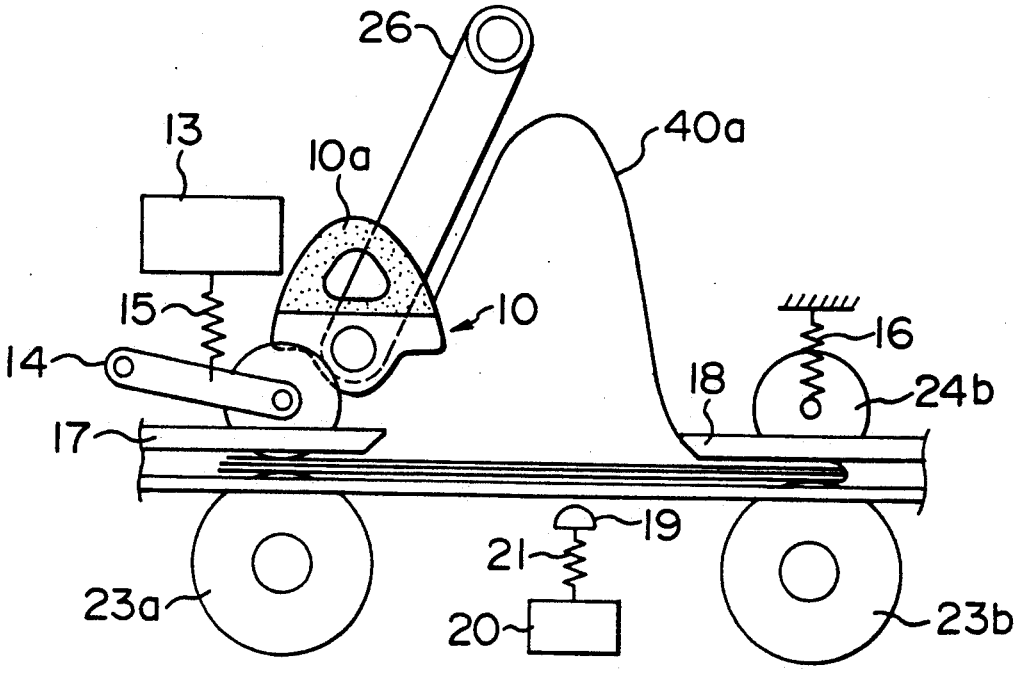
Figure 14:
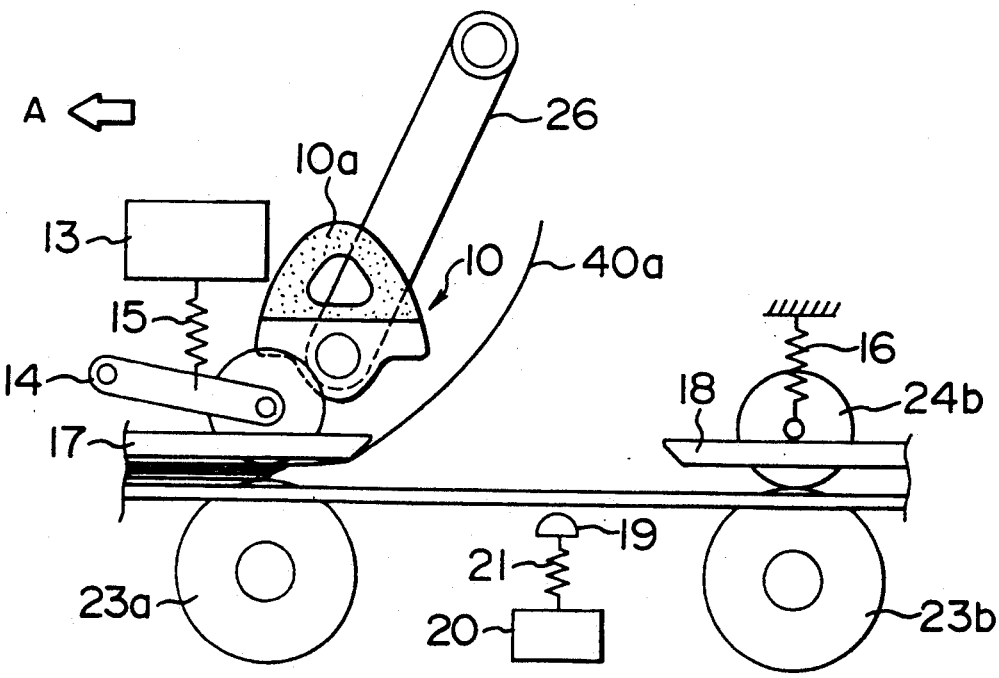

As in the case of FIG. 5, a passbook 40 is held at a specified position with a double-spread page closed (FIG. 10). While rotating, the page-turning roller 10 comes into contact with a sheet 40*a*. As shown in FIG. 11, the drive source 13 is operated to raise the transfer roller 24*a* for a specified time through the intermediary of the spring 15 and the link 14. Therefore, the transfer roller 24*a* is prevented from applying resistance to the sheet being turned over. The page-turning roller 10 continues to rotate as in FIG. 12, and stops after making a specified angle of rotation as in FIG. 13. The page-turning operation is finished by conveying the passbook in the direction of the arrow A as in FIG. 14.

Figure 15:
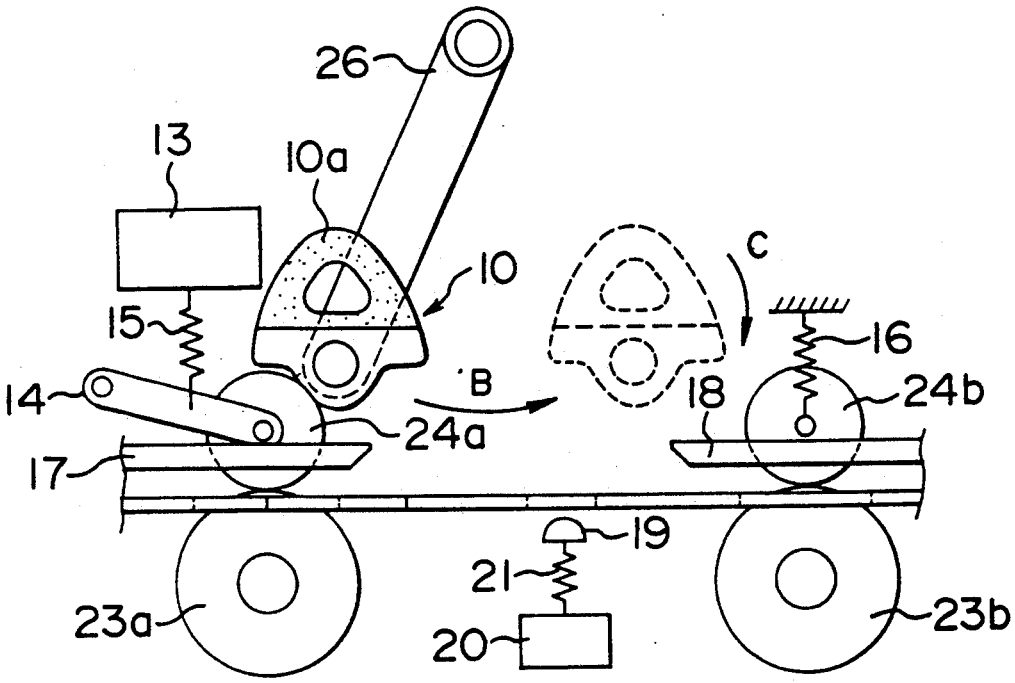

In the page-turning operation, if two or more sheets are turned over by mistake, the page-turning roller 10 is moved in the direction of an arrow B to a position indicated by broken lines as shown in FIG. 15. Then, the page-turning roller 10 is reversed in the clockwise direction C. The other motions are the same as in the page-turning operation described before. In this case, the passbook is brought out in the direction opposite to the direction A mentioned above.

Figure 16:
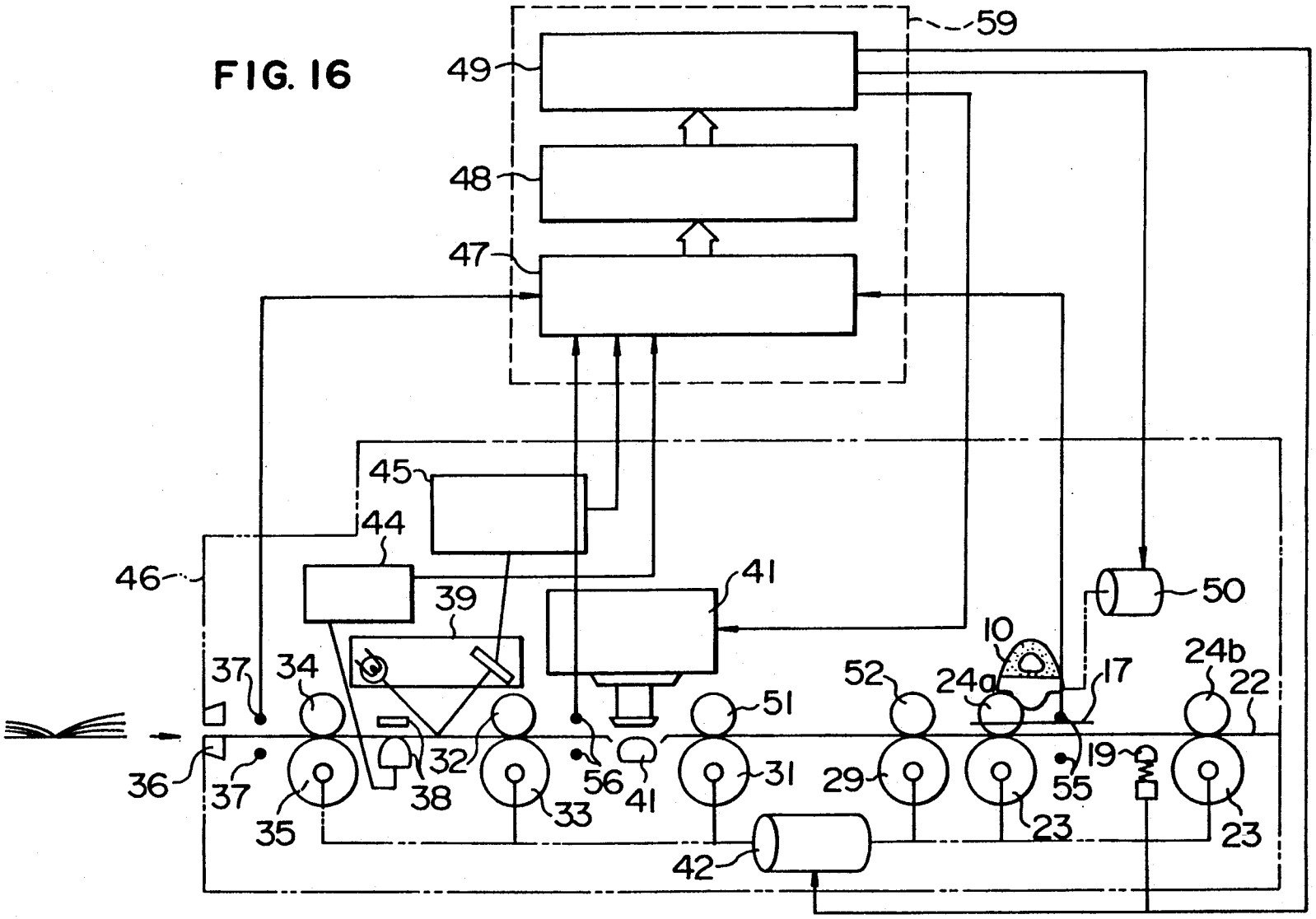
FIG. 16 is a schematic diagram of the passbook printer in accordance with the invention.

FIG. 16 is a diagram for explaining an embodiment of the passbook printer of this invention. According to this invention, the passbook printer basically comprises a transfer system including a transfer path having an inlet/outlet port 36 and a paper pan 22, transfer rollers 34, 35, 32, 33, 51, 31, 52, 29, 24*a*, 24*b*, 23*a*, 23*b* driven by a transfer drive motor 42; sensors 55, 37, 56 for recognizing the presence or absence of a passbook; a printing unit 41; an optical character recognition sensor 39 for reading information of bar codes, etc.; an optical information recognition unit 45; a magnetic information recognition sensor 38 for magnetic stripes, etc. and a magnetic information recognition unit 44; a page-turning section including a page-turning roller 10 driven by a page-turning motor 50, a paper guide 17, and a push guide 19; an external information equipment section 59 including an interface 47, an arithmetic unit 48, and an information operation unit 49; and a power supply unit and an information input/output control unit, both not shown, the latter being for information exchange with an external computer.

Figure 17:
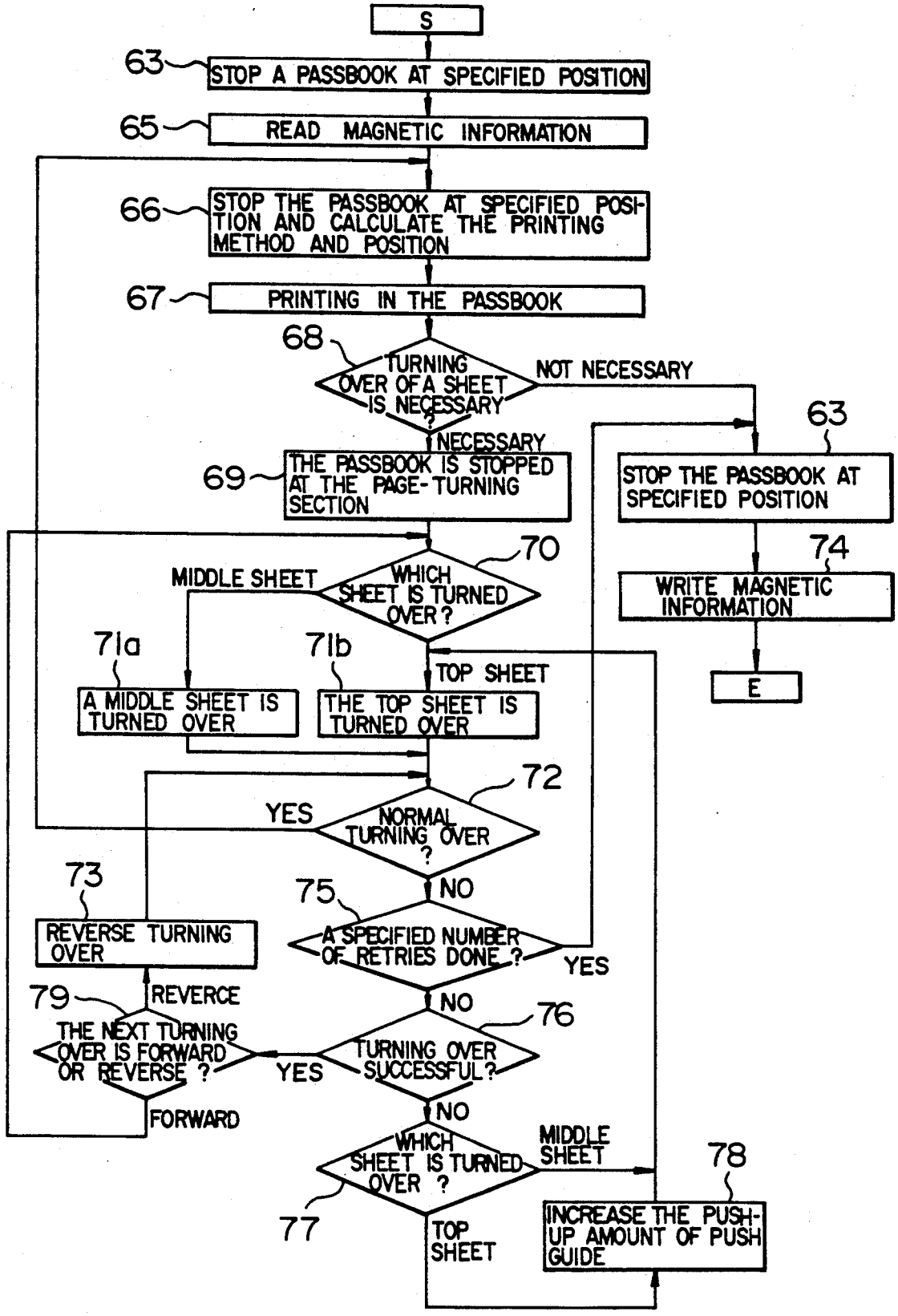
FIG. 17 is an example of control flow of the passbook printer of FIG. 16.
Figure 18:
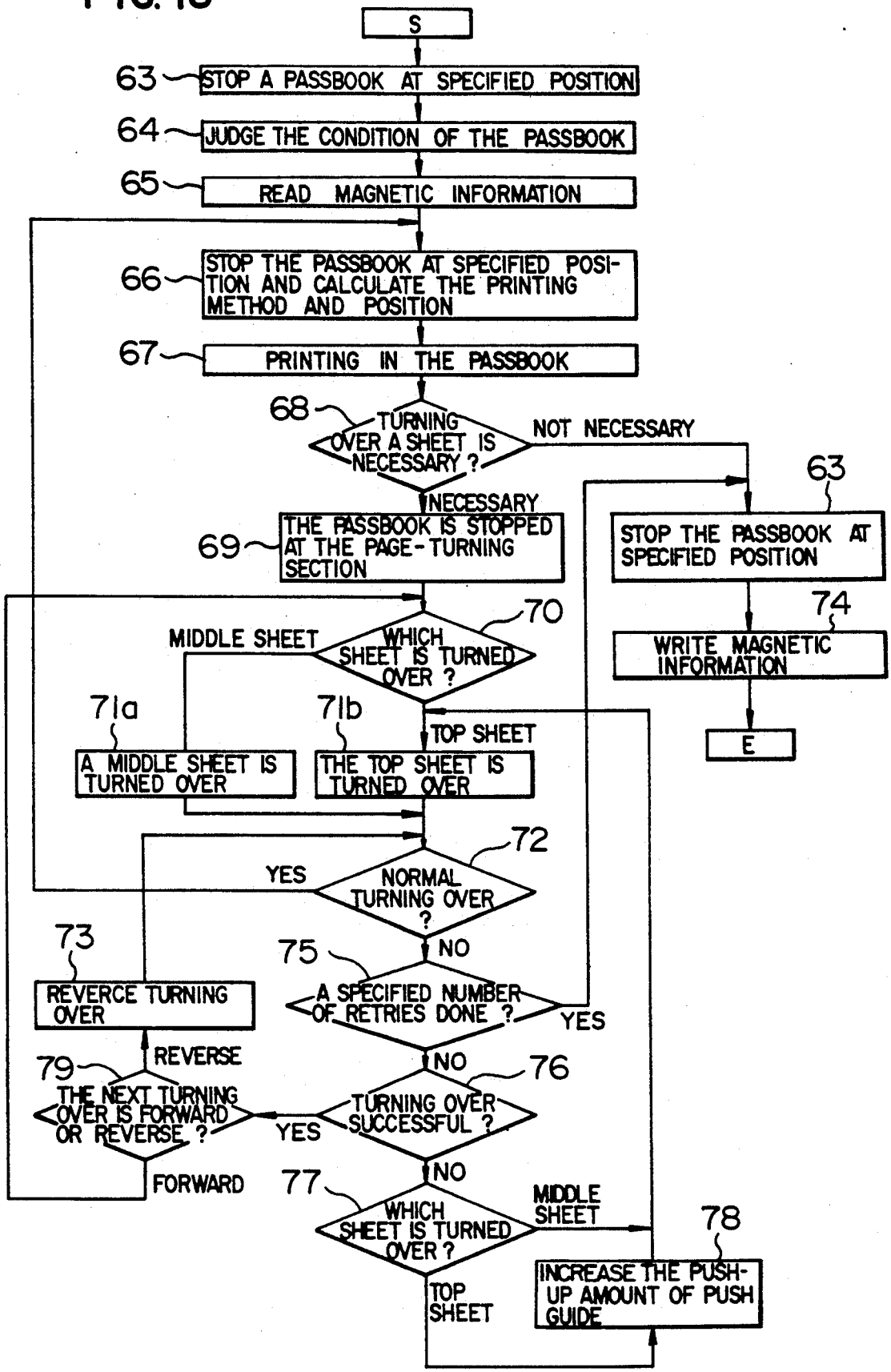
FIG. 18 is a diagram showing essential parts of another example of control flow.

FIG. 17 is a flowchart showing an example of the operation of the passbook printer of FIG. 16. Referring to FIG. 17, the flow of the operation of the passbook will be described. To begin with, the rotation of the rollers of the transfer system is controlled, a passbook is stopped at a specified position (step 63), and information about the passbook is read by a scanning operation by a magnetic information read/write unit 38 (step 65). In this step, as shown in FIG. 18, it is possible to add an operation (step 64) for judging the deformation condition of the passbook by making the optical character recognition sensor 39 scan in a direction perpendicular to the passbook transfer direction. According to the above-mentioned magnetic information given by a sensor 38 and optical information given by a sensor 39, the passbook stop position and the printing method at the printer unit 41 are calculated at a central processing unit (step 66). In compliance with the result of this arithmetic operation, the passbook is stopped at a specified position, and undergoes printing by the printer unit 41 (step 67). Then, a decision is made whether or not turning over of a sheet is necessary (step 68). If a turning-over operation is necessary, in compliance with information about the kind of the passbook, etc. which have already been judged, the passbook is caused to stop at the specified stop position of the page-turning section for passbooks (step 69). According to the passbook information mentioned above, a decision is made whether a top sheet or a middle sheet is to be turned over (step 70). In compliance with this decision, a middle sheet is turned over (step 71*a*) or a top sheet is turned over (step 71*b*). Then, a decision is made by the optical character recognition sensor 39 whether or not the turning over of a sheet has been done correctly (step 72). For the sensor 55, a sensor similar to the optical character recognition sensor 39 may be used, and the above-mentioned decisions may be made at the page-turning section for passbooks.

If the sheet has been turned over correctly, the stop position and the printing method of the passbook at the printer unit 41 are calculated again by the central processing unit (step 66). According to the result of this arithmetic operation, the passbook is stopped at a specified position and undergoes printing by the printer unit 41 (step 67). Next, a decision is made whether or not another page-turning is necessary (step 68). If it is necessary, the above-mentioned operations are repeated.

If another turning over of a sheet is necessary according to the decision (step 68), the passbook is stopped at the specified position (step 63), necessary magnetic information is written in the passbook, the passbook is brought out of the page-turning section, by which a series of the page-turning operations have been finished.

If the turning over of a sheet was not done correctly according to the decision (step 72) about the page-turning operation, a retry is performed. In a retry operation, the number of retries is counted (step 75). When the number of retries reaches a specified number, the retry operation is terminated, the passbook is stopped at the specified positions (step 63), necessary magnetic information is written in the passbook (step 74), and the passbook is brought out of the page turning section.

If the number of retries is less than a specified number, a decision is made whether in the abnormal turning operation, a leaf has been turned over or not (step 76). According to the result of this decision, a decision is made whether in the forward or reverse direction the next turning operation is to be done (step 79). For example, if two or more sheets have been turned over, a reverse turning operation is performed (step 73) as shown in FIG. 15. A decision is made again the leaf has been turned over normally (step 72), and according to the result of this decision, the subsequent steps are performed as described above. When the above-mentioned decision (step 79) on the turning direction indicates that the next turning direction needs to be forward, a decision is made whether a top sheet or a middle sheet is turned over (step 70). Thereafter, the same subsequent steps as mentioned above are performed.

If the decision (step 76) of whether or not a sheet has been turned over in the abnormal turning operation indicates that a sheet has not been turned over, the following two kinds of retries are carried out. If a sheet-turning error occurs in a middle-sheet turning operation, as in the front-sheet turning operation, the push guide 19 is pushed to reduce the buckling resistance force of the passbook, then a top sheet is turned over (step 71*b*). If a turning error occurs in the front-sheet turning operation, the push-up amount of the push guide 19 is controlled to increase (step 78), and the front-sheet is turned over (step 71*b*). Hereafter, the subsequent steps are performed as mentioned above. If the decision (step 68) about whether or not turning over of a sheet is necessary indicates that a sheet need not be turned over, the passbook is stopped at the specified position (step 63), magnetic information is written in the passbook (step 74). In this manner, the page-turning operation is finished, and the passbook is brought out of the apparatus.

According to this invention, there is provided a highly reliable printer for passbooks or the like which can stably turn over the sheets in spite of their initial irregularity in shape or variations in thickness.

What is claimed is:

1. A printer for passbooks or the like, comprising:

a transfer path having transfer means for transferring said passbook or the like;

printing means for printing on a specified page of said passbook or the like brought in on said transfer path;

means for processing an image of said passbook or the like to determine an amount of three-dimensional deformation of the passbook or the like prior to an initial deformation;

means for reading and writing magnetic information on said passbook or the like;

page-turning means, disposed in a vicinity of said transfer path for contacting and turning over a sheet of said passbook or the like; and means disposed in a vicinity of said transfer path and in a position separate from a start position of turning over of a sheet by said page-turning means, for giving an initial deformation to said passbook or the like, wherein with said means for giving an initial deformation to said passbook or the like, the amount of initial deformation is variable in response to the determined amount of deformation of the three-dimensional pattern.

2. A printer for passbooks or the like according to claim 1, wherein with said means for giving an initial deformation to a passbook or the like, the amount of initial deformation is sensed from an image of optical information disposed on said passbook or the like.

3. A printer for passbooks or the like according to claim 9, further comprising:

means for making a decision of whether the page-turning operation is normal or abnormal;

means for controlling, when the page-turning operation is abnormal, the magnitude of the initial deformation and repeating the page-turning operation;

means for counting a series of page-turning operations; and means for not allowing the next page-turning operation to be executed when a count of the counter reaches a specified value.

4. A page-turning apparatus comprising:

a transfer path having transfer means for transferring said passbook or the like;

page-turning means for contacting and turning over a specified sheet of said passbook or the like which is brought in on said transfer path;

means for processing an image of said passbook or the like to determine an amount of three-dimensional deformation of the passbook or the like prior to an initial deformation; and means, disposed in a vicinity of said page-turning means and in a position separate from a start position of turning over of a sheet by said page-turning means, for giving an initial deformation to said passbook or the like with the amount of the initial deformation being variable in response to the determined amount of deformation of the three-dimensional pattern.

5. A page-turning apparatus according to claim 4, wherein said means for giving an initial deformation to a passbook or the like is arranged across said transfer path from said page-turning means.

6. A page-turning apparatus according to claim 4, wherein means for giving an initial deformation to a passbook or the like bends said passbook in an out-of-plane direction so that said passbook is bent in a first-order mode.

7. A page-turning apparatus according to claim 4, further comprising:

means for making a decision of whether the page-turning operation is normal or abnormal in synchronism with the page-turning operation by said page-turning means;

means for counting a number of page-turning operations in a series; and means for controlling said page-turning operation according to a count of counting means.

8. A page-turning apparatus comprising:

a transfer path having transfer means for transferring a passbook or the like;

page-turning means for contacting and turning over a specified sheet of said passbook or the like which is brought in one said transfer path;

means for processing an image of said passbook or the like to determine an amount of three-dimensional deformation of the passbook or the like prior to an initial deformation;

means, disposed in a vicinity of said page-turning means and in a position separate from a start position of turning over of a sheet by said page-turning means, for giving an initial deformation to said passbook or the like; and means for controlling an amount of deformation, caused by means for giving an initial deformation to said passbook or the like in response to the determined amount of deformation of the three-dimensional pattern.

9. A page-turning apparatus according to claim 8, further comprising:

means for making a decision of whether the page-turning operation is normal or abnormal in synchronism with the page-turning operation by said page-turning means;

means for counting a number of page-turning operations in a series; and means for controlling said page-turning operation according to a count of counting means.

* * * * *